US009048038B2

(12) United States Patent
Tak

(10) Patent No.: US 9,048,038 B2
(45) Date of Patent: Jun. 2, 2015

(54) THREE-POSITION ACTUATOR FOR SWITCHGEAR

(71) Applicant: LSIS CO., LTD., Anyang-si, Gyeonggi-do (KR)

(72) Inventor: Sung Jun Tak, Cheongju (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 406 days.

(21) Appl. No.: 13/718,715

(22) Filed: Dec. 18, 2012

(65) Prior Publication Data

US 2013/0168216 A1 Jul. 4, 2013

(30) Foreign Application Priority Data

Dec. 30, 2011 (KR) ..... 10-2011-0147834

(51) Int. Cl.

| | |
|---|---|
| ***H01H 3/40*** | (2006.01) |
| ***H01H 3/44*** | (2006.01) |
| *H01H 31/00* | (2006.01) |
| *H01H 33/42* | (2006.01) |

(52) U.S. Cl.

CPC . *H01H 3/40* (2013.01); *H01H 3/44* (2013.01); *H01H 31/003* (2013.01); *H01H 33/42* (2013.01)

(58) Field of Classification Search

CPC ..... H01H 3/40; H01H 3/00; H01H 3/02; H01H 3/22; H01H 3/32; H01H 3/42; H01H 3/44; H01H 3/46; H01H 3/52; H01H 9/0027; H01H 2003/00; H01H 2003/02; H01H 2009/00; H01H 2009/0005; H01H 2009/016; H01H 2009/088; H01H 2009/0094; H01H 2221/024; H01H 2221/03

See application file for complete search history.

(56) References Cited

U.S. PATENT DOCUMENTS

| | | | | |
|---|---|---|---|---|
| 6,693,247 | B1 * | 2/2004 | Byers et al. | 200/11 TC |
| 2006/0105880 | A1 * | 5/2006 | Gacond et al. | 476/27 |

FOREIGN PATENT DOCUMENTS

| | | |
|---|---|---|
| CN | 100474477 | 4/2009 |
| CN | 101840797 | 9/2010 |
| CN | 101958198 | 1/2011 |
| DE | 3421265 | 12/1984 |

(Continued)

OTHER PUBLICATIONS

European Patent Office Application Serial No. 12197290.5, Search Report dated May 28, 2013, 4 pages.

(Continued)

*Primary Examiner* — Edwin A. Leon
*Assistant Examiner* — Anthony R. Jimenez
(74) *Attorney, Agent, or Firm* — Lee, Hong, Degerman, Kang & Waimey

(57) ABSTRACT

An actuator comprising: a disconnecting switch drive shaft; a first drive gear axially coupled to the drive shaft; a first follower gear in engagement with the first drive gear; a first drive disc having a first drive roller; a first rotary shaft axially supporting the first follower gear and the first drive disc; an earthing switch drive shaft; a second drive gear axially coupled to the earthing switch drive shaft; a second follower gear in engagement with the second drive gear; a second drive disc having a second drive roller; a second rotary shaft; a zeneva disc having a pair of groove portions which the first drive roller or the second drive roller is inserted into or separated from; and a main shaft for switching the disconnecting switch or the earthing switch in accordance with the rotation of the zeneva disc.

3 Claims, 3 Drawing Sheets

(56) References Cited

FOREIGN PATENT DOCUMENTS

| | | |
|---|---|---|
| DE | 4012390 | 10/1991 |
| EP | 0621613 | 10/1994 |
| EP | 1659601 | 5/2006 |
| EP | 2200057 | 6/2010 |
| EP | 2346055 | 7/2011 |
| GB | 1171454 | 11/1969 |
| KR | 10-2005-0031751 | 4/2005 |
| RU | 2154330 | 8/2000 |
| RU | 2344529 | 1/2009 |
| RU | 2396664 | 8/2010 |

OTHER PUBLICATIONS

The State Intellectual Property Office of the People's Republic of China Application Serial No. 201210587625.3, Office Action dated Aug. 25, 2014, 6 pages.

Russian Federation Federal Service for Intellectual Property, Patents and Trademarks Application Serial No. 2012154662/07, Notice of Allowance dated Mar. 27, 2014, 8 pages.

* cited by examiner

THREE-POSITION ACTUATOR FOR SWITCHGEAR

CROSS-REFERENCE TO RELATED APPLICATIONS

Pursuant to 35 U.S.C. §119(a), this application claims the benefit of earlier filing date and right of priority to Korean Application No. 10-2011-0147834, filed on Dec. 30, 2011, the contents of which are hereby incorporated by reference herein in their entirety.

BACKGROUND OF THE INVENTION

1. Field of the Invention

The present disclosure relates to a switchgear having a disconnecting switch and an earthing switch, and more particularly, to a three-position actuator for a switchgear capable of overcoming the problems of a three-position actuator for a switchgear using a single drive shaft which involves the risk of electric shortage due to an overrun.

2. Description of the Conventional Art

A switchgear having a disconnecting switch and an earthing switch is electrical power receiving and transforming equipment which is capable of opening or closing electric lines (the electric power circuit) in the operation and maintenance/repair of an electric power system.

Examples of the switchgear include a gas insulated switchgear with an insulating gas as an interphase insulating medium filled in a case and a solid insulated switchgear using a solid insulating material, such as epoxy, as an insulating medium. For opening, closing and earthing operations of the disconnecting switch in the switchgear, a three-position actuator is used to actuate to three positions including a circuit closing position, an circuit opening position, and an earthing position.

Conventional Example 1 of the three-position switchgear for a switchgear was disclosed in Korean Patent Registration No. 10-0146092 (titled "Gas-Insulated Load Switch and Earthing Method Using the Same") filed by the applicant of the present invention. Conventional Example 2 of the three-position actuator for a switchgear was disclosed in Korean Patent Registration No. 10-0566435 (titled "Three-Position Load Switch With Instant Trip Mechanism") filed by the applicant of the present invention.

Conventional Example 1 concerns an actuator capable of actuating three positions including a circuit closing position, an circuit opening position, and an earthing position by a single drive shaft, which involves the risk of electric shortage or ground fault when the rotation of one drive shaft overruns more than an angle required to actuate to the respective positions.

The actuator disclosed in Conventional Example 2 is a three-position actuator according to Conventional Example 1 to which an instant trip mechanism is added. Like Conventional Example 1, a single drive shaft is provided for three-position actuation, and therefore the rotation of one drive shaft may overrun more than an angle required to actuate to the respective positions and this involves the risk of electric shortage or ground fault.

The three-position actuators according to Conventional Examples 1 and 2 are configured such that the elastic force of a spring is used as a supplementary driving source to actuate the disconnecting switch and the earthing switch to the circuit opening position or circuit closing position. Accordingly, noise may be generated due to collision between a movable mechanism using the expansion and contraction of the spring and a stopper mechanism limiting the displacement of the movable mechanism, an unskilled person may have difficulties in actuation because high manual force is required for manual actuation, thus leading to incomplete actuation, and parts may be abraded and damaged due to collision.

SUMMARY OF THE INVENTION

Therefore, the present invention has been made in an effort to solve the problems occurring in the conventional art, and an aspect of the present invention is to provide a newly configured three-position actuator for a switchgear, which prevents ground fault or electric shortage by preventing any overrun, easily performs manual and automatic actuations with a small force, and does not use the elastic force of a spring for displacement.

To achieve these and other advantages and in accordance with the purpose of the present disclosure, as embodied and broadly described herein, a three-position actuator for a switchgear having a disconnecting switch and an earthing switch, the three-position actuator comprising:

a disconnecting switch switching drive shaft that provides drive torque to actuate the disconnecting switch to a circuit closing position or a circuit opening position;

a first drive gear axially coupled to the disconnecting switch switching drive shaft and being rotatable;

a first follower gear that is driven to rotate in engagement with the first drive gear;

a first drive disc coaxially connected to the first follower gear and being rotatable in the same direction as the first follower gear, and having a first drive roller provide at one side of the top surface so as to be rotatable;

a first rotary shaft that axially supports the first follower gear and the first drive disc;

an earthing switch switching drive shaft that provides drive torque to actuate the earthing switch to the circuit closing position or circuit opening position;

a second drive gear axially coupled to the earthing switch switching drive shaft and being rotatable;

a second follower gear that is driven to rotate in engagement with the second drive gear;

a second drive disc coaxially connected to the second follower gear and being rotatable in the same direction as the second follower gear, and having a second drive roller provided at one side of the top surface;

a second rotary shaft that axially supports the second follower gear and the second drive disc;

a zeneva disc that has a first power transmission groove portion which the first drive roller of the first drive disc is inserted into or separated from and a second power transmission groove portion which the second drive roller of the second drive disc is inserted into or separated from, is connected to the first drive disc or second drive disc within a predetermined range of angle and rotates by the power transmitted from the first drive disc or second drive disc, and is stopped as the power transmission is automatically stopped if the zeneva disc is out of the predetermined range of angle; and a main shaft that is axially coupled to the zeneva disc and connected to the disconnecting switch and the earthing switch, and drives the disconnecting switch or the earthing switch to the circuit closing position or the circuit opening position in accordance with the rotation of the zeneva disc.

According to a preferred aspect of the present invention, the first power transmission groove portion and the second power transmission groove portion are formed toward the rotational center of the zeneva disc at two predetermined positions on the outer circumferential surface of the zeneva disc, spaced apart from each other at a predetermined angle, and formed symmetrically to each other.

According to another preferred aspect of the present invention, the first drive disc includes a first idle protrusion that radially extends from a shaft coupling portion at the center and has the shape of a arc so as to protrude upward, the second drive disc includes a second idle protrusion that radially extends from a shaft coupling portion at the center and has the shape of a arc so as to protrude upward, and the zeneva disc further includes a first idle groove portion having the shape of a arc and provided to correspond to the first idle protrusion of the first drive disc and a second idle groove portion having the shape of a arc and provided to correspond to the second idle protrusion of the second drive disc.

BRIEF DESCRIPTION OF THE DRAWINGS

The accompanying drawings, which are included to provide a further understanding of the invention and are incorporated in and constitute a part of the present disclosure, illustrate exemplary embodiments and together with the description serve to explain the principles of the invention.

In the drawings.

DETAILED DESCRIPTION OF THE INVENTION

Figure 1:
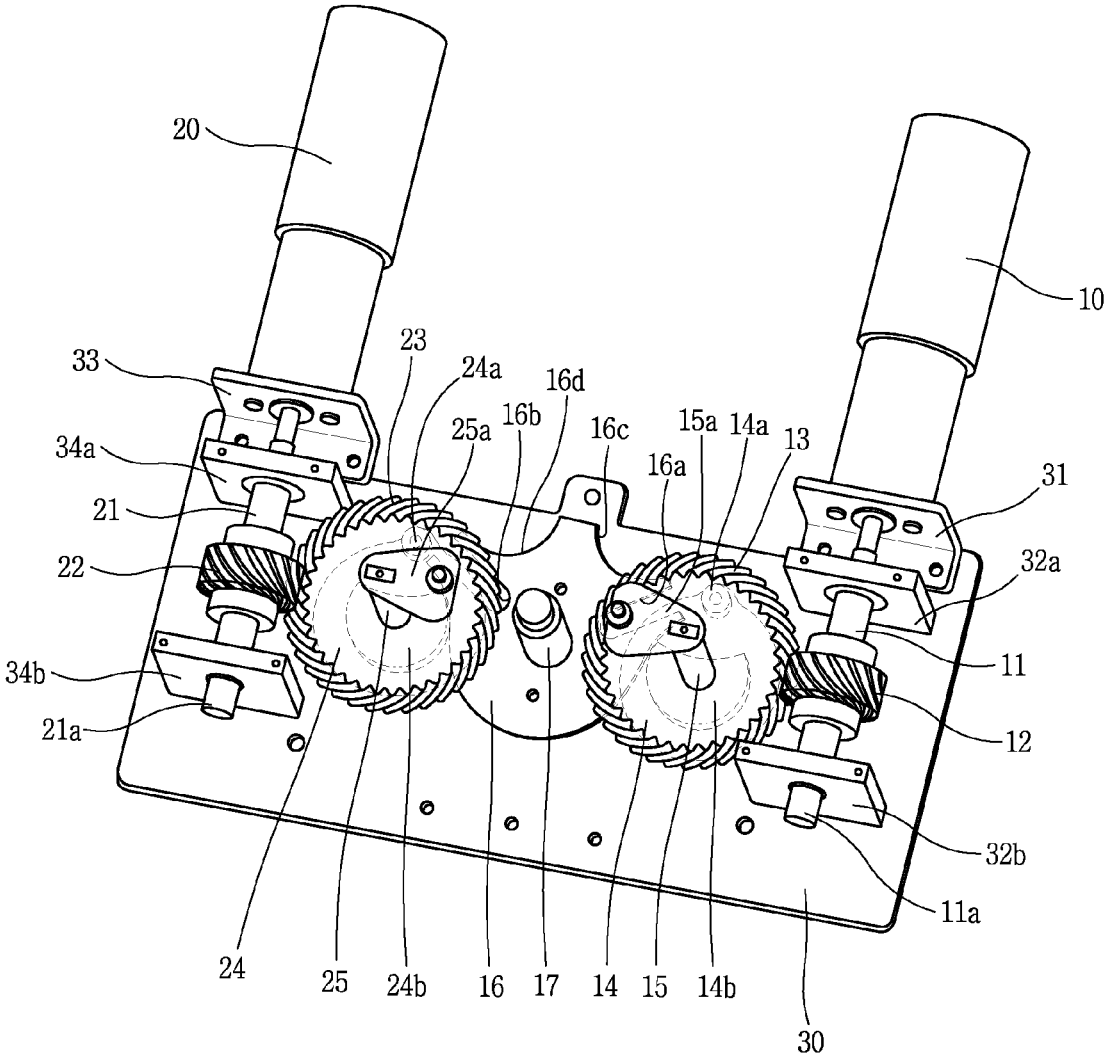
FIG. 1 is a perspective view showing the overall configuration of a three-position actuator for a switchgear according to a preferred embodiment of the present invention, as viewed obliquely from an upper position and, at the same time an operation state view showing a circuit opening state (position) of a disconnecting switch and a circuit opening state (position) of an earthing switch.
Figure 2:
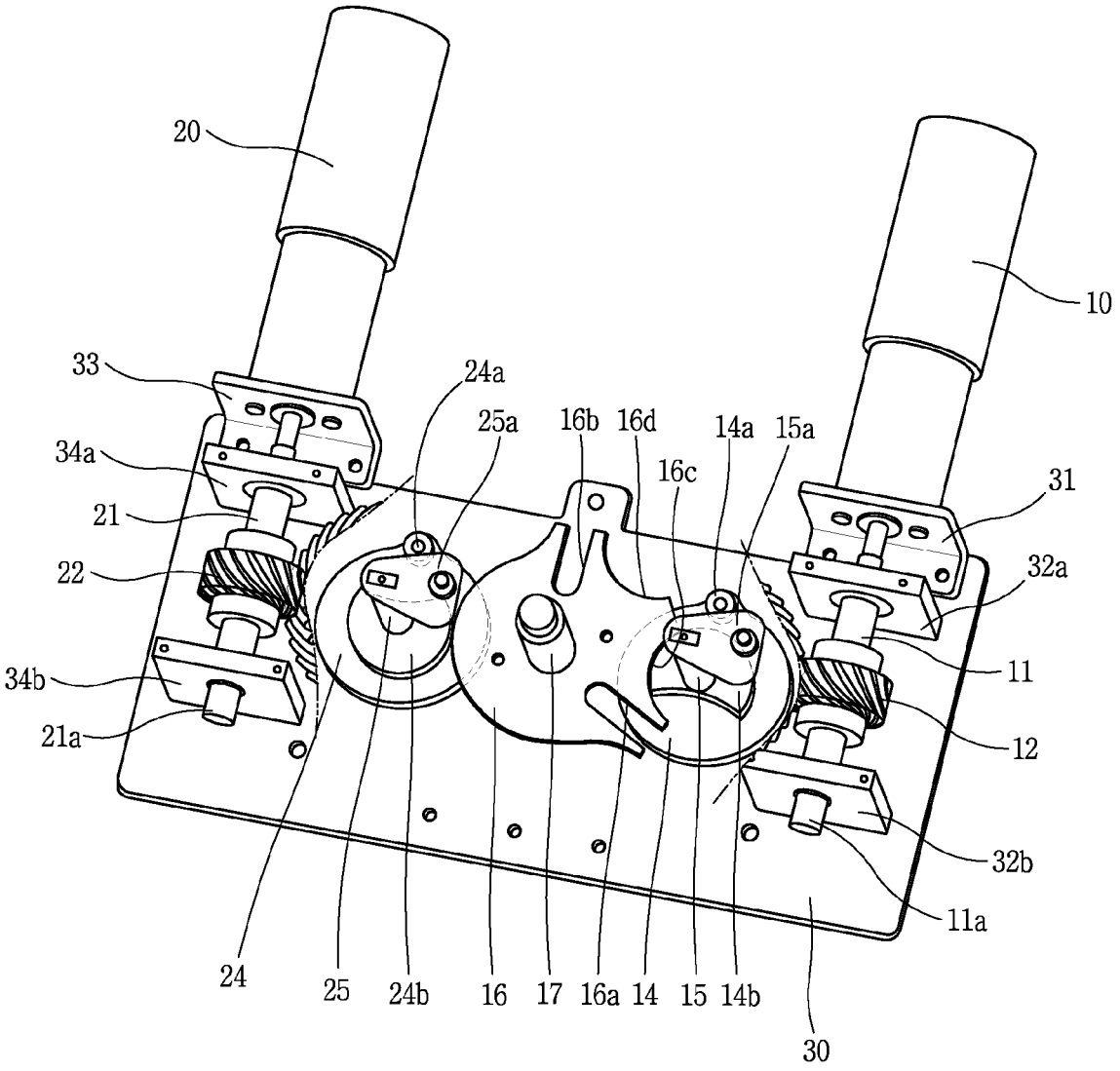
FIG. 2 is a diagram showing an operation state for actuating the disconnecting switch to a circuit closing position, in the three-position actuator for the switchgear according to the preferred embodiment of the present invention.
Figure 3:
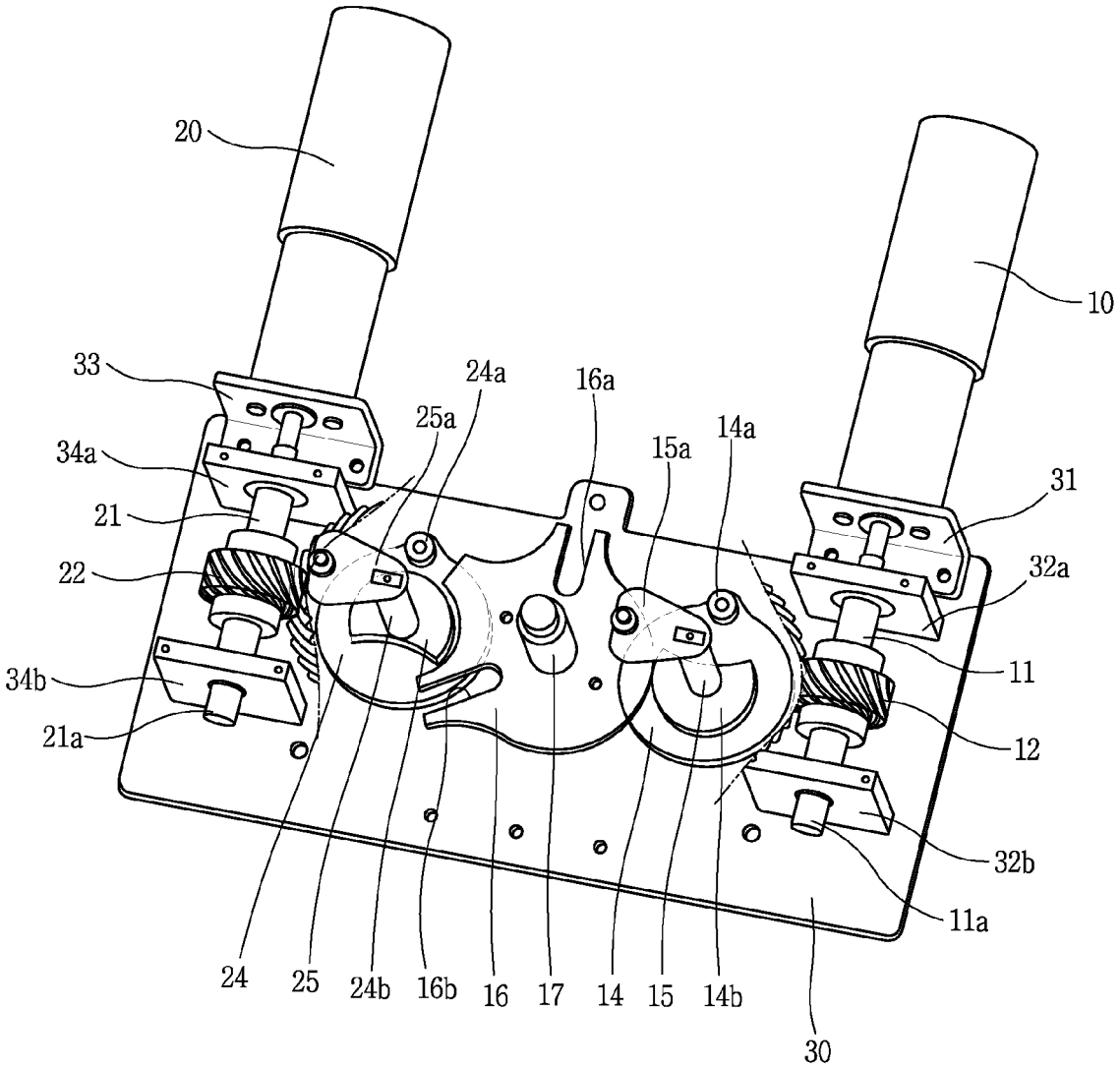
FIG. 3 is a diagram showing an operation state for actuating the earthing switch to a circuit closing state (position), in the three-position actuator for the switchgear according to the preferred embodiment of the present invention.

The objects of the present invention, the configuration for achieving the object and operational effects thereof will be understood more obviously by a detailed description of a preferred embodiment according to the present invention, with reference to FIGS. 1 to 3.

A three-position actuator according to a preferred embodiment of the present invention can be installed at a switchgear having a disconnecting switch (not shown) and an earthing switch (not shown).

As is well known, the disconnecting switch is an electrical power apparatus of an electric power receiving and distributing equipment which is used for the purpose of transfer of electric power lines, dividing of electric power lines or separating an electric equipment not connected with an electrical load from an electrical power circuit. Unlike a circuit breaker, the disconnecting switch has no protection function of detecting abnormality on an electric power circuit and automatically breaking the circuit, but only the function of opening or closing the circuit.

The earthing switch is a device that protects a worker by discharging (earthing) charged current remaining after interrupting the disconnecting switch to the ground.

Referring to FIG. 1, the three-position actuator according to the preferred embodiment of the present invention includes a disconnecting switch switching drive shaft 11, a first drive gear 12, a first follower gear 13, a first drive disc 14, a first rotary shaft 15, an earthing switch switching drive shaft 21, a second drive gear 22, a second follower gear 23, a second drive disc 14, a second rotary shaft 25, a zeneva disc 16, and a main shaft 17.

In FIG. 1, reference numeral 10 designates a first drive motor, reference numeral 15*a* designates a first lever, reference numeral 20 designates a second drive motor, reference numeral 25*a* designates a second lever, reference numeral 30 designates a supporting base, reference numeral 31 designates a first motor supporting bracket, reference numeral 32*a* designates a first shaft supporting plate, reference numeral 32*b* designates a second shaft supporting plate, reference numeral 33 designates a second motor supporting bracket, reference numeral 34*a* designates a third shaft supporting plate, and reference numeral 34*b* designates a fourth shaft supporting plate.

The disconnecting switch switching drive shaft 11 is a shaft that provides drive torque so as to actuate the disconnecting switch to a circuit closing position or an circuit opening position. The drive torque provided by the disconnecting switch switching drive shaft 11 is obtained from motorized torque of the first drive motor 10 or from manual force of a user. To this end, one end of the disconnecting switch switching drive shaft 11 may be connected to an output shaft of the first drive motor 10, and the other end 11*a* of the disconnecting switch switching drive shaft 11 can be connected to a handle (not shown).

The first drive gear 12 is a gear that is rotatable by being axially coupled to the disconnecting switch switching drive shaft 11.

The first follower gear 13 rotates in engagement with the first drive gear 12. In other words, the first follower gear 13 engages with the first drive gear 12 and rotates in accordance with the rotation of the first drive gear 12, and stops rotating when the first drive gear 12 stops rotating.

The first follower gear 13 rotates by being axially coupled to the first rotary shaft 15, and the disconnecting switch switching drive shaft 11 to be axially coupled to the first drive gear 12 is installed to form a right angle (that is 90 degrees) with the first rotary shaft 15. According to the embodiment shown in FIG. 1, the disconnecting switch switching drive shaft 11 is horizontally installed in a lying posture, and the first rotary shaft 15 is vertically installed in a standing posture.

The first drive disc 14 is a disc-like member that transmits the drive torque transmitted from the first follower gear 13 to the zeneva disc 16. The first drive disc 14 is coaxially connected to the first follower gear 13, and is rotatable in the same direction as the first follower gear 13 in accordance with the rotation of the first follower gear 13. The first drive disc 14 has a first drive roller 14*a* at one side of the top surface.

The first drive roller 14*a* is a member that transmits the drive torque of the first drive disc 14 finally to the zeneva disc 16. Although the first drive roller 14*a* may be replaced with a pin which is to be fixed to the same position to perform the same function, a rotatable roller is used according to the preferred embodiment to minimize impact generated upon contacting a first power transmission groove portion 16*a* of the zeneva disc 16 and to facilitate its separation from the first power transmission groove portion 16*a*. The outside of the first drive roller 14*a* is preferably made of a natural elastic material, such as rubber, or a synthetic elastic material for damping.

The first drive disc 14 includes a first idle protrusion 14*b* that radially extends from a shaft coupling portion at the center and has the shape of a arc so as to protrude upward. A first idle groove portion 16*c* having the shape of a arc is formed on the zeneva disc 16, which is to be described later, to correspond to the first idle protrusion 14*b*, whereby the first idle protrusion 14*b* is not stopped by the zeneva disc 16 to allow rotation without interference.

The first rotary shaft 15 axially supports the first follower gear 13 and the first drive disc 14 so as to be rotatable.

The earthing switch switching drive shaft 21 is a shaft that provides drive torque so as to actuate the earthing switch to a circuit closing position (i.e., earthing position) or an circuit opening position (earthing stop position).

The drive torque provided by the earthing switch switching drive shaft 21 is obtained from motorized torque of the second drive motor 20 or from manual force of the user.

To this end, one end of the earthing switch switching drive shaft 21 may be connected to an output shaft of the second drive motor 20, and the other end 21*a* of the earthing switch switching drive shaft 21 can be connected to a handle (not shown) to which the user provides their manual force.

The second drive gear 22 is a gear that is rotatable by being axially coupled to the earthing switch switching drive shaft 21.

The second follower gear 23 rotates in engagement with the second drive gear 22. In other words, the second follower gear 23 engages with the second drive gear 22 and rotates in accordance with the rotation of the second drive gear 22, and stops rotating when the second drive gear 22 stops rotating.

The second follower gear 23 rotates by being axially coupled to the second rotary shaft 25, and the earthing switch switching drive shaft 21 to be axially coupled to the second drive gear 22 is installed to form a right angle with the second rotary shaft 25. According to the embodiment shown in FIG. 1, the earthing switch switching drive shaft 21 is horizontally installed in a lying posture, and the second rotary shaft 25 is vertically installed in a standing posture.

The second drive disc 24 is a disc-like member that transmits the drive torque transmitted from the second follower gear 23 to the zeneva disc 16. The second drive disc 24 is coaxially connected to the second follower gear 23, and is rotatable in the same direction as the second follower gear 23 in accordance with the rotation of the second follower gear 23. The second drive disc 24 has a second drive roller 24*a* at one side of the top surface.

The second drive roller 24*a* is a member that transmits the drive torque of the second drive disc 24 finally to the zeneva disc 16. Although the second drive roller 24*a* may be replaced with a pin which is to be fixed to the same position to perform the same function, a rotatable roller is used according to the preferred embodiment to minimize impact generated upon contacting a second power transmission groove portion 16*b* of the zeneva disc 16 and to facilitate its separation from the second power transmission groove portion 16*b*. The outside of the second drive roller 24*a* is preferably made of a natural elastic material, such as rubber, or a synthetic elastic material for damping.

The second drive disc 24 includes a second idle protrusion 24*b* that radially extends from a shaft coupling portion at the center and has the shape of a arc so as to protrude upward. A second idle groove portion 16*d* having the shape of a arc is formed on the zeneva disc 16, which is to be described later, to correspond to the second idle protrusion 24*b*, whereby the second idle protrusion 24*b* is not stopped by the zeneva disc 16 to allow rotation without interference.

The second rotary shaft 25 axially supports the second follower gear 23 and the second drive disc 24 so as to be rotatable.

The zeneva disc 16 is a passive device that is connected to the first drive disc 14 or second drive disc 24 within a predetermined range of angle and, rotates by the torque transmitted from the first drive disc 14 or second drive disc 24, and is stopped as the power transmission is automatically stopped if it is out of the predetermined range of angle.

The zeneva disc 16 includes a first power transmission groove portion 16*a* which the first drive roller 14*a* of the first drive disc 14 is inserted into or separated from at a predetermined rotation angle and a second power transmission groove portion 16*b* which the second drive roller 24*a* of the second drive disc 24 is inserted into or separated from. The first power transmission groove portion 16*a* and the second power transmission groove portion 16*b* are formed toward the rotational center of the zeneva disc 16 at two predetermined positions on the outer circumferential surface of the zeneva disc 16, spaced apart from each other at a predetermined angle, and formed symmetrically to each other. Moreover, the zeneva disc 16 further includes a first idle groove portion 16*c* provided to correspond to the first idle protrusion 14*b* of the first drive disc 14 and having the shape of a arc and a second idle groove portion 16*d* provided to correspond to the second idle protrusion 24*b* of the second drive disc 24 and having the shape of an arc.

The main shaft 17 is axially coupled to the zeneva disc 16 and connected to the disconnecting switch and the earthing switch through a power transmission mechanism such as a lever or link (not shown), and rotates in accordance with the rotation of the zeneva disc 16 so that drives the disconnecting switch or the earthing switch to the circuit closing position or the circuit opening position.

In FIG. 1, the first drive motor 10 is means for providing a motorized power source to drive the disconnecting switch (not shown) to the circuit closing position or the circuit opening position, and the second drive motor 20 is means for providing a motorized power source to drive the earthing switch (not shown) to the circuit closing position or the circuit opening position.

The first lever 15*a* is axially coupled to the first rotary shaft 15 and rotatable in accordance with the rotation of the first rotary shaft 15. The first lever 15*a* can be brought into contact with a limit switch (not shown) for stopping the rotation for the first drive motor 10 or a stopper (not shown) for stopping the rotation of the first lever 15*a* at a predetermined position.

The second lever 25*a* is axially coupled to the second rotary shaft 25 and rotatable in accordance with the rotation of the second rotary shaft 25. The second lever 25*a* can be brought into contact with a limit switch (not shown) for stopping the rotation for the second drive motor 20 or a stopper (not shown) for stopping the rotation of the second lever 25*a* at a predetermined position.

The supporting base 30 supports the components of the three-position actuator.

A first motor supporting bracket 31 supports the first drive motor 10, and a second motor supporting bracket 33 supports the second drive motor 20.

The first shaft supporting plate 32*a* and the second shaft supporting plate 32*b* are supporting members that respectively support the disconnecting switching switch drive shaft 11 at both opposite ends.

The third shaft supporting plate 34*a* and the fourth shaft supporting plate 34*b* are supporting members that respectively support the earthing switch switching switch drive shaft 21 at both opposite ends.

An operation of the three-position actuator for the switchgear configured as described above according to the preferred embodiment of the present invention will be described with reference to FIGS. 1 to 3.

Referring to FIG. 1 showing an operation state of the three-position actuator according to the preferred embodiment of the present invention when the disconnecting switch is at the circuit opening position and the disconnecting switch is also at the circuit opening position, FIG. 2 showing an operation state of the three-position actuator according to the preferred embodiment of the present invention for actuating the disconnecting switch to the circuit closing position, and FIG. 3 showing an operation process of the three-position actuator according to the preferred embodiment of the present invention for actuating the earthing switch to the circuit closing position will be described.

To actuate the disconnecting switch to the circuit closing position in the state shown in FIG. 1, the first drive motor 10 is driven by an electrical command signal, or the handle (not shown) is connected to the other end 11*a* of the disconnecting switch switching drive shaft 11, so that the user manually rotates the disconnecting switch switching drive shaft 11 in a clockwise direction, which is a direction for actuating the disconnecting switch to the circuit closing position.

Then, the first drive gear 12 axially coupled to the disconnecting switch switching drive shaft 11 also rotates clockwise.

Hereupon, the first follower gear 13 engaged (teeth meshed with) with the first drive gear 12 rotates counter-clockwise, and the first drive disc 14 coaxially connected to the first follower gear 13 and the first rotary shaft 15 also rotate counter-clockwise.

Then, the first drive roller 14*a* installed at one side of the first drive disc 14 also rotates counter-clockwise to insert the first drive roller 14*a* into the first power transmission groove portion 16*a* of the zeneva disc 16, thereby pressurizing the first power transmission groove portion 16*a* and rotating the zeneva disc 16 clockwise. As the first drive disc 14 rotates further counter-clockwise, the first drive roller 14*a* is separated from the first power transmission groove portion 16*a*, and therefore the zeneva disc 16 is stopped at a position rotated clockwise from the position of FIG. 1 about 60 degrees and the zeneva disc 16 goes into the state (position) of FIG. 2.

Consequently, the main shaft 17 being rotatable by being coaxially connected to the zeneva disc 16 rotates clockwise about 60 degrees, whereby the disconnecting switch connected to the main shaft 17 through a power transmission mechanism switch such as a lever or link (not shown) moves to the circuit closing position.

Afterwards, when the first drive disc 14 rotates further counter-clockwise, the first idle protrusion 14*b* of the first drive disc 14 is positioned to face the first idle groove portion 16*c* of the zeneva disc 16, and hence the first drive disc 14 idly rotates.

At this point, the first lever 15*a* axially coupled to the first rotary shaft 15 is stopped from rotating by the stopper (not shown), or the first lever 15*a* operates the limit switch (not shown) installed at a predetermined position to allow the limit switch to break the electric power supply to the first drive motor 10 and stop the first drive motor 10, thereby completing an circuit closing position operation of the disconnecting switch.

An operation of actuating the disconnecting switch from the circuit closing position of FIG. 2 to the circuit opening position of FIG. 1 will be described below.

To actuate the disconnecting switch to the circuit opening position in the state shown in FIG. 2, the first drive motor 10 is driven by an electrical command signal, or the handle (not shown) is connected to the other end 11*a* of the disconnecting switch switching drive shaft 11, so that the user manually rotates the disconnecting switch switching drive shaft 11 in a counter-clockwise direction, which is a direction for actuating the disconnecting switch to the circuit opening position.

Then, the first drive gear 12 axially coupled to the disconnecting switch switching drive shaft 11 also rotates counter-clockwise.

Hereupon, the first follower gear 13 engaged with (teeth meshed with) the first drive gear 12 rotates clockwise, and the first drive disc 14 coaxially connected to the first follower gear 13 and the first rotary shaft 15 also rotate clockwise.

Then, the first drive roller 14*a* installed at one side of the first drive disc 14 also rotates clockwise to insert the first drive roller 14*a* into the first power transmission groove portion 16*a* of the zeneva disc 16, thereby pressurizing the first power transmission groove portion 16*a* and rotating the zeneva disc 16 counter-clockwise. As the first drive disc 14 rotates further clockwise, the first drive roller 14*a* is separated from the first power transmission groove portion 16*a*, and therefore the zeneva disc 16 is stopped at a position rotated counter-clockwise from the position of FIG. 2 about 60 degrees and the zeneva disc 16 goes into the state (position) of FIG. 1.

Consequently, the main shaft 17 being rotatable by being coaxially connected to the zeneva disc 16 rotates counter-clockwise about 60 degrees, whereby the disconnecting switch connected to the main shaft 17 through a power transmission mechanism switch such as a lever or link (not shown) moves to the circuit opening position.

At this point, the first lever 15*a* axially coupled to the first rotary shaft 15 is stopped from rotating by the stopper (not shown), or the first lever 15*a* operates the limit switch (not shown) installed at a predetermined position to allow the limit switch to cut off and stop the power supplied to the first drive motor 10, thereby completing an circuit opening position operation of the disconnecting switch.

An operation of the three-position actuator according to the preferred embodiment of the present invention which actuates the earthing switch from the circuit opening position (earthing stopped state) of FIG. 1 to an circuit closing position (earthing state) of FIG. 3 will be described below.

To actuate the earthing switch to the circuit closing position (in other words, earthing position) in the state shown in FIG. 1, the second drive motor 20 is driven by an electrical command signal, or the handle (not shown) is connected to the other end 21*a* of the earthing switch switching drive shaft 21, so that the user manually rotates the earthing switch switching drive shaft 21 in a counter-clockwise direction, which is a direction for actuating the earthing switch to the circuit closing position.

Then, the second drive gear 22 axially coupled to the earthing switch switching drive shaft 21 also rotates counter-clockwise.

Hereupon, the second follower gear 23 engaged with (teeth meshed with) the second drive gear 22 rotates clockwise, and the second drive disc 24 coaxially connected to the second follower gear 23 and the second rotary shaft 25 also rotate clockwise.

Then, the second drive roller 24*a* installed at one side of the second drive disc 24 also rotates clockwise to insert the second drive roller 24*a* into the second power transmission groove portion 26*a* of the zeneva disc 16, thereby pressurizing the second power transmission groove portion 16*b* and rotating the zeneva disc 16 counter-clockwise. As the second drive disc 24 rotates further clockwise, the second drive roller 24*a* is separated from the second power transmission groove portion 16*b*, and therefore the zeneva disc 16 is stopped at a position rotated counter-clockwise from the position of FIG. 1 about 60 degrees and the zeneva disc 16 goes into the state (position) of FIG. 3.

Consequently, the main shaft 17 being rotatable by being coaxially connected to the zeneva disc 16 rotates counter-clockwise about 60 degrees, whereby the earthing switch connected to the main shaft 17 through a power transmission mechanism switch such as a lever or link (not shown) moves to the circuit closing position (earthing position).

Afterwards, when the second drive disc 24 rotates further clockwise, the second idle protrusion 24*b* of the second drive disc 24 is positioned to face the second idle groove portion 16*d* of the zeneva disc 16, and hence the second drive disc 24 idly rotates.

At this point, the second lever 25*a* axially coupled to the second rotary shaft 25 is stopped from rotating by the stopper (not shown), or the second lever 25*a* operates the limit switch (not shown) installed at a predetermined position to allow the limit switch to break the electric power supply to the second drive motor 20 and stop the second drive motor 20, thereby completing an circuit closing position operation of the earthing switch.

An operation of the three-position actuator according to the preferred embodiment of the present invention which actuates the earthing switch from the circuit closing position (state) of FIG. 3 to the circuit opening position (state) of FIG. 1 will be described below.

To actuate the earthing switch to the circuit opening position (in other words, earthing stop position) in the state shown in FIG. 3, the second drive motor 20 is driven by an electrical command signal, or the handle (not shown) is connected to the other end 21*a* of the earthing switch switching drive shaft 21, so that the user manually rotates the earthing switch switching drive shaft 21 in a clockwise direction, which is a direction for actuating the earthing switch to the circuit opening position.

Then, the second drive gear 22 axially coupled to the earthing switch switching drive shaft 21 also rotates clockwise.

Hereupon, the second follower gear 23 engaged with (teeth meshed with) the second drive gear 22 rotates counter-clockwise, and the second drive disc 24 coaxially connected to the second follower gear 23 and the second rotary shaft 25 also rotate counter-clockwise.

Then, the second drive roller 24*a* installed at one side of the second drive disc 24 also rotates counter-clockwise to insert the second drive roller 24*a* into the second power transmission groove portion 26*a* of the zeneva disc 16, thereby pressurizing the second power transmission groove portion 16*b* and rotating the zeneva disc 16 clockwise. As the second drive disc 24 rotates further counter-clockwise, the second drive roller 24*a* is separated from the second power transmission groove portion 16*b*, and therefore the zeneva disc 16 is stopped at a position rotated clockwise from the position of FIG. 3 about 60 degrees and the zeneva disc 16 goes into the state (position) of FIG. 1.

Consequently, the main shaft 17 being rotatable by being coaxially connected to the zeneva disc 16 rotates clockwise about 60 degrees, whereby the earthing switch connected to the main shaft 17 through a power transmission mechanism switch such as a lever or link (not shown) moves to the circuit opening position (earthing stop position).

At this point, the second lever 25*a* axially coupled to the second rotary shaft 25 is stopped from rotating by the stopper (not shown), or the second lever 25*a* operates the limit switch (not shown) installed at a predetermined position to allow the limit switch to break the electric power supply to the second drive motor 20 and stop the motor 20, thereby completing an circuit opening position operation of the earthing switch.

As described above, in the three-position actuator for the switchgear according to the present invention, the disconnecting switch switching drive shaft 11 and the earthing switch switching drive shaft 21 are separately configured, the first drive disc 14 having the first drive roller 14*a* and the second drive disc 24 having the second drive roller 24*a* are respectively configured to open or close the disconnecting switch and the earthing switch, and the zeneva disc 16 and the main shaft 17 are commonly configured for the disconnecting switch and the earthing switch. Even if the first rotary shaft 15 or the second rotary shaft 25 overruns due to damage of the stopper or malfunctioning of the limit switch after the disconnecting switch switching drive shaft 11 or the earthing switch switching drive shaft 21 is rotated to the circuit opening position or the circuit closing position, the first driver roller 14*a* or the second drive roller 24*a* is separated from the zeneva disc 16, thus stopping the power transmission to the zeneva disc 16. Therefore, the main shaft 17, which is a final output shaft, will not overrun, thereby basically preventing electric shortage or ground fault.

Moreover, the three-position actuator for the switchgear according to the present invention does not use the elastic force of an switching spring as switching drive force, but instead uses power transmission obtained by connecting the first drive gear 12 or second drive gear 22 axially coupled to a motorized or manually drive shaft, i.e., the disconnecting switch switching drive shaft 11 or earthing switch switching drive shaft 21, to the first follower gear 13 or second drive gear 23, and connecting or disconnecting the zeneva disc 16 to or from the first drive roller 14*a* or second drive roller 24*a*, thereby opening or closing the disconnecting switch and the earthing switch. Accordingly, impact and noise due to the instant elastic energy discharging of the spring are not generated, opening or closing operations can be performed smoothly and quietly, the possibility of an incomplete operation can be significantly reduced even if an unskilled person manipulates the actuator, and damage of the components can be minimized.

What is claimed is:

1. A three-position actuator for a switchgear having a disconnecting switch and an earthing switch, the three-position actuator comprising:

a disconnecting switch switching drive shaft that provides drive torque to actuate the disconnecting switch to a circuit closing position or a circuit opening position;

a first drive gear axially coupled to the disconnecting switch switching drive shaft and being rotatable;

a first follower gear that is driven to rotate in engagement with the first drive gear;

a first drive disc coaxially connected to the first follower gear and being rotatable in the same direction as the first follower gear, and having a first drive roller provided at one side of a top surface so as to be rotatable;

a first rotary shaft that axially supports the first follower gear and the first drive disc;

an earthing switch switching drive shaft that provides drive torque to actuate the earthing switch to the circuit closing position or circuit opening position;

a second drive gear axially coupled to the earthing switch switching drive shaft and being rotatable;

a second follower gear that is driven to rotate in engagement with the second drive gear;

a second drive disc coaxially connected to the second follower gear and being rotatable in the same direction as the second follower gear, and having a second drive roller provided at one side of the top surface;

a second rotary shaft that axially supports the second follower gear and the second drive disc;

a zeneva disc that has a first power transmission groove portion which the first drive roller of the first drive disc is inserted into or separated from and a second power transmission groove portion which the second drive roller of the second drive disc is inserted into or separated from, is connected to the first drive disc or second drive disc within a predetermined range of angles and rotates by the power transmitted from the first drive disc or second drive disc, and is stopped as the power transmission is automatically stopped if the zeneva disc is out of the predetermined range of angles; and a main shaft that is axially coupled to the zeneva disc and connected to the disconnecting switch and the earthing switch, and drives the disconnecting switch or the earthing switch to the circuit closing position or the circuit opening position in accordance with the rotation of the zeneva disc.

2. The three-position actuator of claim 1, wherein the first power transmission groove portion and the second power transmission groove portion are formed toward the rotational center of the zeneva disc at two predetermined positions on the outer circumferential surface of the zeneva disc, spaced apart from each other at a predetermined angle, and formed symmetrically to each other.

3. The three-position actuator of claim 2, wherein the first drive disc comprises a first idle protrusion that radially extends from a shaft coupling portion at the center and has the shape of an arc so as to protrude upward, the second drive disc comprises a second idle protrusion that radially extends from a shaft coupling portion at the center and has the shape of an arc so as to protrude upward, and the zeneva disc further comprises a first idle groove portion having the shape of an arc and provided to correspond to the first idle protrusion of the first drive disc and a second idle groove portion having the shape of an arc and provided to correspond to the second idle protrusion of the second drive disc.

* * * * *